US009728136B2

(12) United States Patent
Pyo et al.

(10) Patent No.: US 9,728,136 B2
(45) Date of Patent: Aug. 8, 2017

(54) ORGANIC LIGHT EMITTING DISPLAY DEVICE

(71) Applicant: SAMSUNG DISPLAY CO., LTD., Yongin, Gyeonggi-Do (KR)

(72) Inventors: Dong-Hak Pyo, Hwaseong-si (KR); Jae-Hoon Lee, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 153 days.

(21) Appl. No.: 14/694,817

(22) Filed: Apr. 23, 2015

(65) Prior Publication Data

US 2016/0063961 A1 Mar. 3, 2016

(30) Foreign Application Priority Data

Sep. 3, 2014 (KR) ..... 10-2014-0117289

(51) Int. Cl.
*G09G 3/3266* (2016.01)
*G09G 3/20* (2006.01)

(52) U.S. Cl.
CPC ..... *G09G 3/3266* (2013.01); *G09G 3/2022* (2013.01); *G09G 2310/0205* (2013.01); *G09G 2310/0216* (2013.01)

(58) Field of Classification Search
CPC ..... G09G 3/2022; G09G 3/3266; G09G 2310/0216; G09G 2310/0205
See application file for complete search history.

(56) References Cited

U.S. PATENT DOCUMENTS

2010/0295837 A1* 11/2010 Yoshinaga ..... G09G 3/003 345/211
2012/0113090 A1* 5/2012 Minami ..... G09G 3/3648 345/213
2012/0169678 A1 7/2012 Shin
2013/0314385 A1 11/2013 Kim

FOREIGN PATENT DOCUMENTS

KR 10-2010-0124656 A 11/2010
KR 10-2013-0104733 A 9/2013
KR 10-2013-0131668 A 12/2013

* cited by examiner

*Primary Examiner* — Shaheda Abdin
(74) *Attorney, Agent, or Firm* — Lewis Roca Rothgerber Christie LLP

(57) ABSTRACT

An organic light emitting diode (OLED) display device includes: a display panel including a first through (2M)-th row pixel blocks; a data driver including a first data driving unit to provide N odd row data signals to (2K−1)-th row pixel blocks and a second data driving unit to provide N even row data signals to (2K)-th row pixel blocks; a scan driver including a first scan driving unit configured to provide (2K−1)-th scan signals to (2K−1)-th row pixel blocks and a second scan driving unit configured to provide (2K)-th scan signals to (2K)-th row pixel blocks. The first frame period includes an activation period and a vertical blank period. The first scan driving unit is configured to activate the (2K−1)-th scan signals sequentially in pulse form in an activation period.

19 Claims, 12 Drawing Sheets

ORGANIC LIGHT EMITTING DISPLAY DEVICE

CROSS-REFERENCE TO RELATED APPLICATION

This application claims priority to and the benefit of Korean Patent Application No. 10-2014-0117289, filed on Sep. 3, 2014 in the Korean Intellectual Property Office (KIPO), the content of which is incorporated herein in its entirety by reference.

BACKGROUND

1. Field

Example embodiments of the present invention relate generally to a display device. More particularly, embodiments of the present invention relate to an organic light emitting diode (OLED) display device with reduced image distortion.

2. Description of the Related Art

Organic light emitting diode (OLED) display devices have been widely used recently as flat display devices included in electronic devices, which are getting smaller and consuming less power. Generally, an OLED display device implements (i.e., displays) a specific gray level using a voltage stored in a storage capacitor of each pixel (i.e., an analog driving technique for an OLED display device). However, the analog driving technique may not accurately implement a desired gray level because the analog driving technique uses the voltage (i.e., an analog value) stored in the storage capacitor of each pixel.

To overcome these problems, a digital driving technique for an OLED display device has been developed. For example, the digital driving technique displays a frame by displaying a plurality of sub-frames. The frame may be divided into a plurality of the sub-frames. For example, the digital driving technique may set light emitting times of the sub-frames differently from each other (e.g., by a factor of 2). In another example, in the digital driving technique, the light emitting times of the sub-frames may be set according to a ratio which is pre-determined by a user. The digital driving technique may implement a specific gray level using a sum of emission times of the sub-frames.

According to a dual scan method, data signals are provided to pixels in parallel by activating two scan signals concurrently (e.g., simultaneously). The dual scan method enables digital driving on a larger OLED display device by enlarging the data writing time per a pixel.

In one scheme, the dual scan method divides display panel to multiple regions spatially. However, image distortion may occur between divided regions.

SUMMARY

Example embodiments of the present invention may provide an organic light emitting diode (OLED) display device with reduced image distortion generated by vertical blanks.

According to some example embodiments, an OLED display device includes a display panel, a timing controller, a data driver, and a scan driver. The display panel includes first through (2M)-th row pixel blocks. Each of the first through (2M)-th row pixel blocks has N pixels. M and N are natural numbers. The timing controller is configured to generate first data bits, second data bits, first scan control signals, and second scan control signals based on a clock signal and input image data. The data driver includes first data driving unit and second data driving units. The first data driving unit is configured to generate N odd row data signals in response to the first data bits and to provide the N odd row data signals to the (2K−1)-th row pixel blocks (K=1, 2, . . . , M). The second data driving unit is configured to generate N even row data signals in response to the second data bits and to provide the N even row data signals to the (2K)-th row pixel blocks. The scan driver includes first and second scan driving units. The first scan driving unit is configured to generate (2K−1)-th scan signals in response to the first scan control signal and to provide the (2K−1)-th scan signals to the (2K−1)-th row pixel blocks, respectively. The second scan driving unit is configured to generate (2K)-th scan signals in response to the second scan control signal and to provide the (2K)-th scan signals to the (2K)-th row pixel blocks, respectively. A first frame period includes an activation period and a vertical blank period. The first scan driving unit is configured to activate the (2K−1)-th scan signals sequentially in pulse form in the activation period and the second scan driving unit is configured to activate the (2K)-th scan signals sequentially in pulse form in the activation period. The first and second scan driving units are configured to deactivate the first through (2M)-th scan signals in the vertical blank period.

In an example embodiment, the first scan driving unit may be configured to activate the (2K−1)-th scan signals sequentially in pulse form from the first scan signal to the (2M−1)-th scan signal in the activation period, and the second scan driving unit may be configured to activate the (2K)-th scan signals sequentially in pulse form from the second scan signal to the (2M)-th scan signal in the activation period.

In an example embodiment, the first scan driving unit may be configured to activate the (2K−1)-th scan signals sequentially in pulse form from the (2M−1)-th scan signal to the first scan signal in the activation period, and the second scan driving unit may be configured to activate the (2K)-th scan signals sequentially in pulse form from the (2M)-th scan signal to the second scan signal in the activation period.

In an example embodiment, the first scan driving unit may be configured to activate the (2K−1)-th scan signals selectively in the activation period, and the second scan driving unit may be configured to activate the (2K)-th scan signals selectively in the activation period.

In an example embodiment, the (2K−1)-th scan signals may be the same as the (2K)-th scan signals.

In an example embodiment, the (L)-th row pixel block may be adjacent to the (L+1)-th row pixel block. L is a natural number equal to or less than 2M.

In an example embodiment, the N pixels in the (L)-th row pixel block may be configured to operate in response to the (L)-th scan signal. L is a natural number equal to or less than 2M.

In an example embodiment, the N pixels in the (2P−1)-th row pixel block may be configured to operate in response to the N odd row data signals. P is a natural number equal to or less than M.

In an example embodiment, the N pixels in the (2P)-th row pixel block may be configured to operate in response to the N even row data signals. P is a natural number equal to or less than M.

In an example embodiment, the activation period may include a plurality of sub-frame periods, and the OLED display device may be configured to utilize a digital driving method which represents a gray level of a pixel included in the display panel based on a sum of light emitting time of the sub-frame periods.

In an example embodiment, the first data bits may represent whether or not pixels in the (2K−1)-th row pixel blocks emit light in the sub-frame periods sequentially, and the second data bits may represent whether or not pixels in the (2K)-th row pixel blocks emit light in the sub-frame periods sequentially.

In an example embodiment, the display panel may be configured to display an image in response to the input image data in the activation period.

In an example embodiment, the display panel may be configured to maintain a last image, which is displayed at end of the activation period, in the vertical blank period.

In an example embodiment, the timing controller may be configured to change a length of the activation period and a length of the vertical blank period according to a frequency of the clock signal when the frequency of the clock signal is changed.

In an example embodiment, the timing controller may be configured to calculate a luminance level of a second frame period subsequent to the first frame period in the vertical blank period.

In an example embodiment, the timing controller may be configured to determine an image effect of a second frame period subsequent to the first frame period in the vertical blank period.

According to another example embodiment, an OLED display device includes a display panel, a timing controller, a data driver, and a scan driver. The display panel includes first through (M*L)-th row pixel blocks. Each of the first through (M*L)-th row pixel blocks has N pixels. L, M, and N are natural numbers. The timing controller configured to generate first through (L)-th data bits and first through (L)-th scan control signals based on a clock signal and input image data. The data driver includes first through (L)-th data driving units. The scan driver includes first through (L)-th scan driving units. The (P)-th data driving unit is configured to generate (P)-th data signals in response to the (P)-th data bits and to provide the (P)-th data signals to the (K*L+P)-th row pixel blocks (K=0, 1, . . . , M−1). P is a natural number equal to or less than L. The (P)-th scan driving unit is configured to generate (K*L+P)-th scan signals in response to the (P)-th scan control signal and provides the (K*L+P)-th scan signals to the (K*L+P)-th row pixel blocks, respectively. A frame period includes an activation period and a vertical blank period. The (P)-th scan driving unit is configured to activates the (K*L+P)-th scan signals sequentially in pulse form in the activation period. The first through (L)-th scan driving units are configured to deactivate the first through (M*L)-th scan signals in the vertical blank period.

In an example embodiment, the (P)-th scan driving unit may be configured to activate the (K*L+P)-th scan signals sequentially in pulse form from the (P)-th scan signal to the ((M−1)*L+P)-th scan signal in the activation period.

In an example embodiment, the (P)-th scan driving unit may be configured to activate the (K+L+P)-th scan signals sequentially in pulse form from the ((M−1)*L+P)-th scan signal to the (P)-th scan signal in the activation period.

As described above, the OLED display device according to example embodiments of the present invention may reduce a luminance change caused by a frequency change of the clock signal for EMI minimization by inserting a vertical blank period into a frame period, thereby reducing image distortion. The OLED display device according to example embodiments of the present invention may calculate a luminance level of a next frame or may determine an image effect of the next frame in the vertical blank period.

BRIEF DESCRIPTION OF THE DRAWINGS

Illustrative, non-limiting example embodiments of the present invention will be more clearly understood from the following detailed description taken in conjunction with the accompanying drawings.

DETAILED DESCRIPTION

Figure 1:
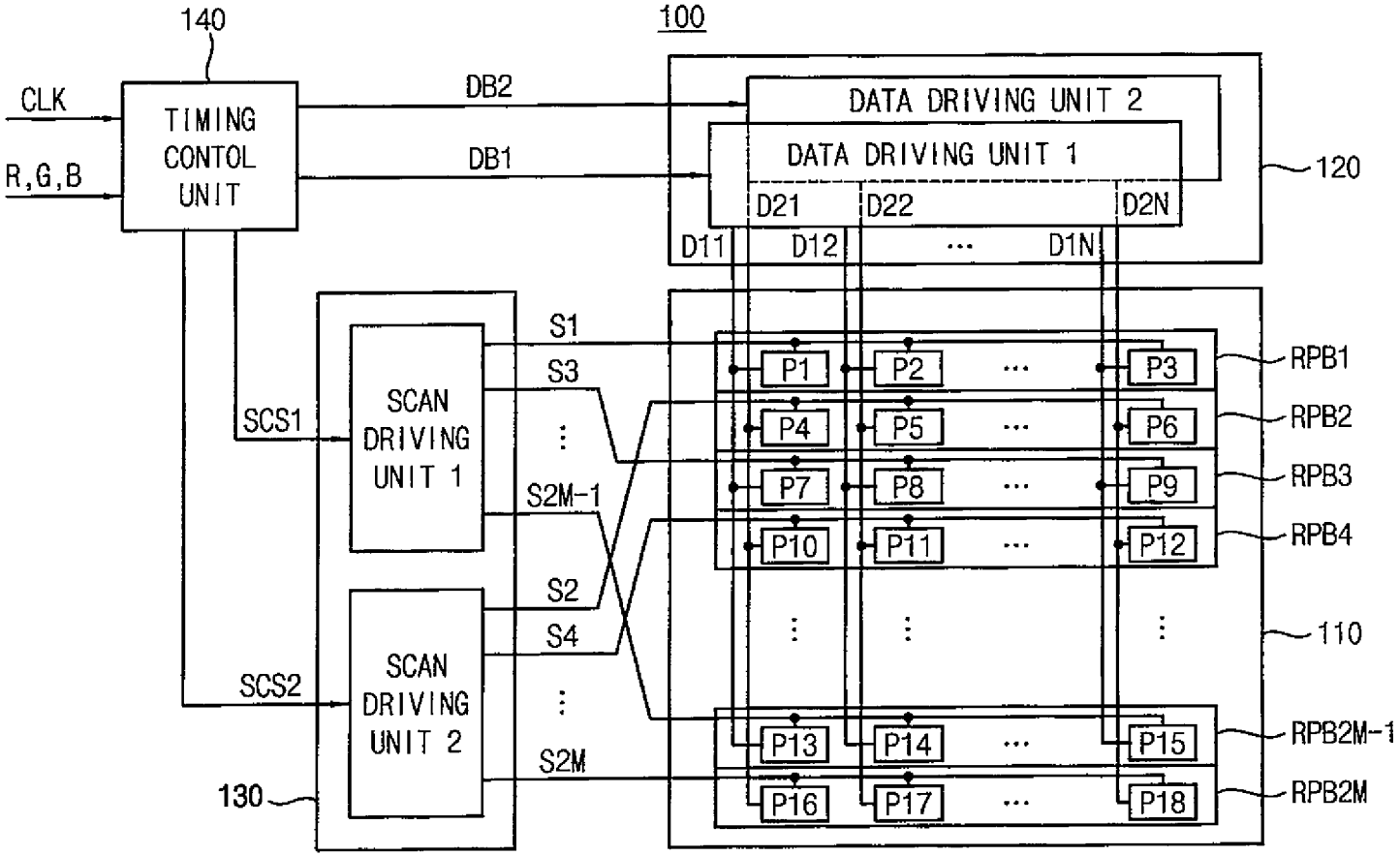
FIG. 1 is a block diagram illustrating an organic light emitting diode (OLED) display device according to an example embodiment.

Various example embodiments of the present invention will be described more fully hereinafter with reference to the accompanying drawings, in which some example embodiments are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity. Like numerals refer to like elements throughout.

It will be understood that, although the terms first, second, third, etc. may be used herein to describe various elements, these elements should not be limited by these terms. These terms are used to distinguish one element from another. Thus, a first element discussed below could be referred to instead as a second element without departing from the scope and teachings of the present invention. As used herein, the term "and/or" includes any and all combinations of one or more of the associated listed items.

Expressions such as "at least one of," when preceding a list of elements, modify the entire list of elements and do not modify the individual elements of the list. Further, the use of "may" when describing embodiments of the present invention refers to "one or more embodiments of the present invention."

It will be understood that when an element is referred to as being "connected" or "coupled" to another element, it can be directly connected or coupled to the other element or intervening elements may be present. When an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the terms "use," "using," and "used" may be considered synonymous with the terms "utilize," "utilizing," and "utilized," respectively.

Unless otherwise defined, all terms (including technical and scientific terms) used herein have the same meaning as commonly understood by one of ordinary skill in the art to which embodiments of the present invention belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating an organic light emitting diode (OLED) display device according to an example embodiment of the present invention.

Referring to FIG. 1, an OLED display device 100 includes a display panel 110, a timing controller 140, a data driver 120, and a scan driver 130.

The display panel 110 includes first through (2M)-th row pixel blocks RPB1, RPB2, RPB3, RPB4, RPB2M−1, RPB2M (M is a natural number). Each of the first through (2M)-th row pixel blocks RPB1, RPB2, RPB3, RPB4, RPB2M−1, RPB2M has N pixels (e.g., first through third pixels) (N is a natural number). For example, the first row pixel block RPB1 includes first through third pixels P1, P2, and P3, the second row pixel block RPB2 includes fourth through sixth pixels P4, P5, and P6, the third row pixel block RPB3 includes seventh through ninth pixels P7, P8, and P9, the fourth row pixel block RPB4 includes tenth through twelfth pixels P10, P11, and P12, the (2M−1)-th row pixel block RPB2M−1 includes thirteenth through fifteenth pixels P13, P14, and P15, and the (2M)-th row pixel block RPB2M includes sixteenth through eighteenth pixels P16, P17, and P18. While only example pixels P1 through P18 are shown in FIG. 1, the display panel 110 according to example embodiments may include additional pixels corresponding to the natural numbers N and M.

The timing controller 140 generates first and second data bits DB1, DB2 and first and second scan control signals SCS1, SCS2 based on a clock signal CLK and input image data R, G, B.

The data driver 120 includes first and second data driving units DATA DRIVING UNIT 1, DATA DRIVING UNIT 2 (e.g., first and second data drivers DATA DRIVING UNIT 1, DATA DRIVING UNIT 2). The first data driving unit DATA DRIVING UNIT 1 generates N odd row data signals D11, D12, . . . , D1N in response to the first data bits DB1 and provide the N odd row data signals D11, D12, . . . , D1N to the (2K−1)-th row pixel blocks RPB1, RPB3, RPB2M−1 (K=1, 2, . . . , M). The second data driving unit DATA DRIVING UNIT 2 generates N even row data signals D21, D22, . . . , D2N in response to the second data bits DB2 and provide the N even row data signals D21, D22, D2N to the (2K)-th row pixel blocks RPB2, RPB4, and RPB2M.

The scan driver 130 includes first and second scan driving units SCAN DRIVING UNIT 1, SCAN DRIVING UNIT 2 (e.g., first and second scan drivers SCAN DRIVING UNIT 1, SCAN DRIVING UNIT 2). The first scan driving unit SCAN DRIVING UNIT 1 generates (2K−1)-th scan signals S1, S3, . . . , S2M−1 in response to the first scan control signal SCS1 and provide the (2K−1)-th scan signals S1, S3, . . . , S2M−1 to the (2K−1)-th row pixel blocks RPB1, RPB3, RPB2M−1 respectively. The second scan driving unit SCAN DRIVING UNIT 2 generates (2K)-th scan signals S2, S4, S2M in response to the second scan control signal SCS2 and provide the (2K)-th scan signals S2, S4, S2M to the (2K)-th row pixel blocks RPB2, RPB4, RPB2M respectively.

A first frame period includes an activation period and a vertical blank period. The first scan driving unit SCAN DRIVING UNIT 1 activates the (2K−1)-th scan signals S1, S3, . . . , S2M−1 sequentially in pulse form in the activation period and the second scan driving unit SCAN DRIVING UNIT 2 activates the (2K)-th scan signals S2, S4, . . . , S2M sequentially in pulse form in the activation period. The first and second scan driving units SCAN DRIVING UNIT1, SCAN DRIVING UNIT 2 deactivate the first through (2M)-th scan signals S1, S2, S3, S4, . . . , S2M−1, S2M in the vertical blank period.

Operation of the first through (2M)-th scan signals S1, S2, S3, S4, S2M−1, S2M in the first frame period, the activation period, and the vertical blank period will be described with the references to FIGS. 2, 3, 4A, 5A, and 6A.

The (L)-th row pixel block (L is a natural number equal to or less than 2M) may be adjacent (e.g., directly adjacent) to the (L+1)-th row pixel block. For example, the first row pixel block RPB1 may be adjacent to the second row pixel block RPB2, the second row pixel block RPB2 may be adjacent to the third row pixel block RPB3, the third row pixel block RPB3 may be adjacent to the fourth row pixel block RPB4, and the (2M−1)-th row pixel block RPB2M−1 may be adjacent to the (2M)-th row pixel block RPB2M.

The N pixels included in the (L)-th row pixel block (L is a natural number equal to or less than 2M) may operate in response to the (L)-th scan signal. The N pixels included in the (2P−1)-th row pixel block (P is a natural number equal to or less than M) may operate in response to the N odd row data signals D11, D12, . . . , D1N. The N pixels included in the (2P)-th row pixel block may operate in response to the N even row data signals D21, D22, . . . , D2N.

For example, the first through third pixels P1, P2, P3 may operate in response to the first scan signal S1 and the N odd row data signals D11, D12, . . . , D1N. The fourth through sixth pixels P4, P5, P6 may operate in response to the second scan signal S2 and the N even row data signals D21, D22, . . . , D2N. The seventh through ninth pixels P7, P8, P9 may operate in response to the third scan signal S3 and the N odd row data signals D11, D12, . . . , D1N. The tenth through twelfth pixels P10, P11, P12 may operate in response to the fourth scan signal S4 and the N even row data signals D21, D22, . . . , D2N. The thirteenth through fifteenth pixels P13, P14, P15 may operate in response to the (2M−1)-th scan signal S2M−1 and the N odd row data signals D11, D12, . . . , D1N. The sixteenth through eighteenth pixels P16, P17, P18 may operate in response to the (2M)-th scan signal S2M and the N even row data signals D21, D22, . . . , D2N.

The first scan driving unit SCAN DRIVING UNIT 1 may activate the (2K−1)-th scan signals S1, S3, . . . , S2M−1 selectively in the activation period, and the second scan driving unit SCAN DRIVING UNIT 2 may activate the (2K)-th scan signals S2, S4, . . . , S2M selectively in the activation period.

In an example embodiment, the (2K−1)-th scan signals S1, S3, . . . , S2M−1 may be the same or substantially the same as the (2K)-th scan signals S2, S4, . . . , S2M.

Figure 2:
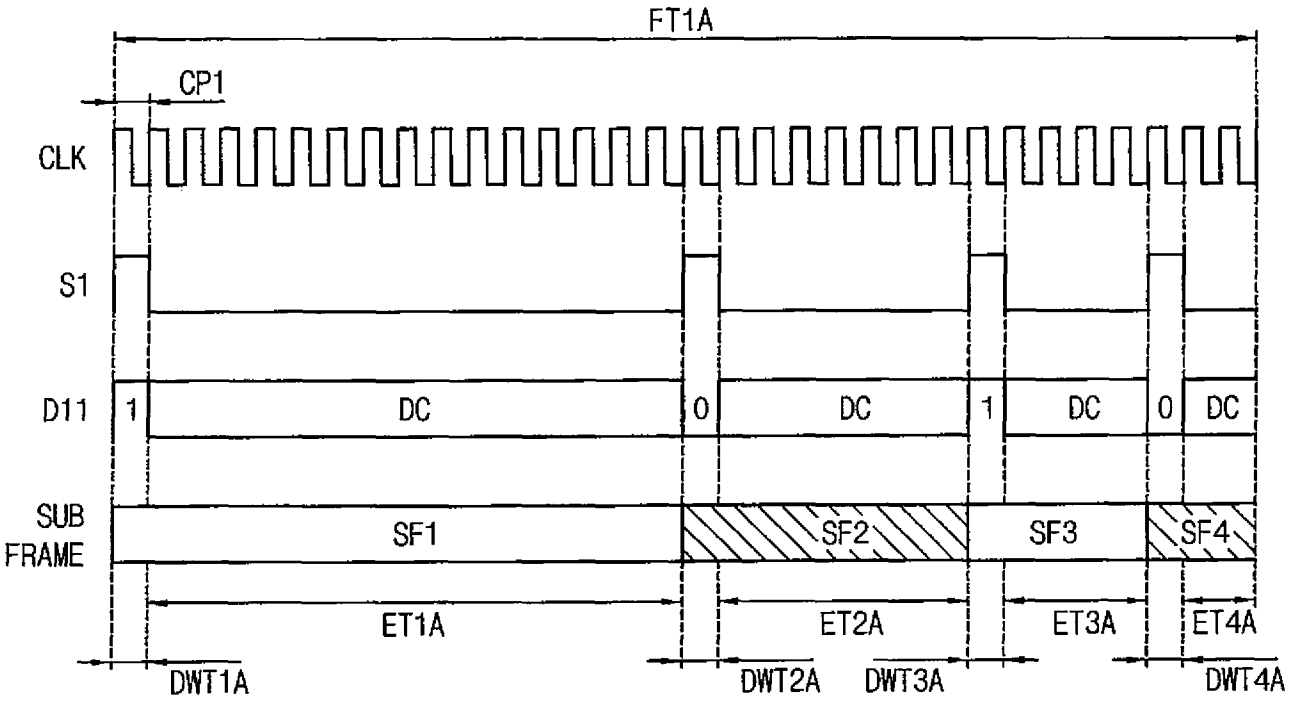
FIGS. 2 and 3 are timing diagrams illustrating operation of the first pixel included in the OLED display device of FIG. 1.
Figure 3:
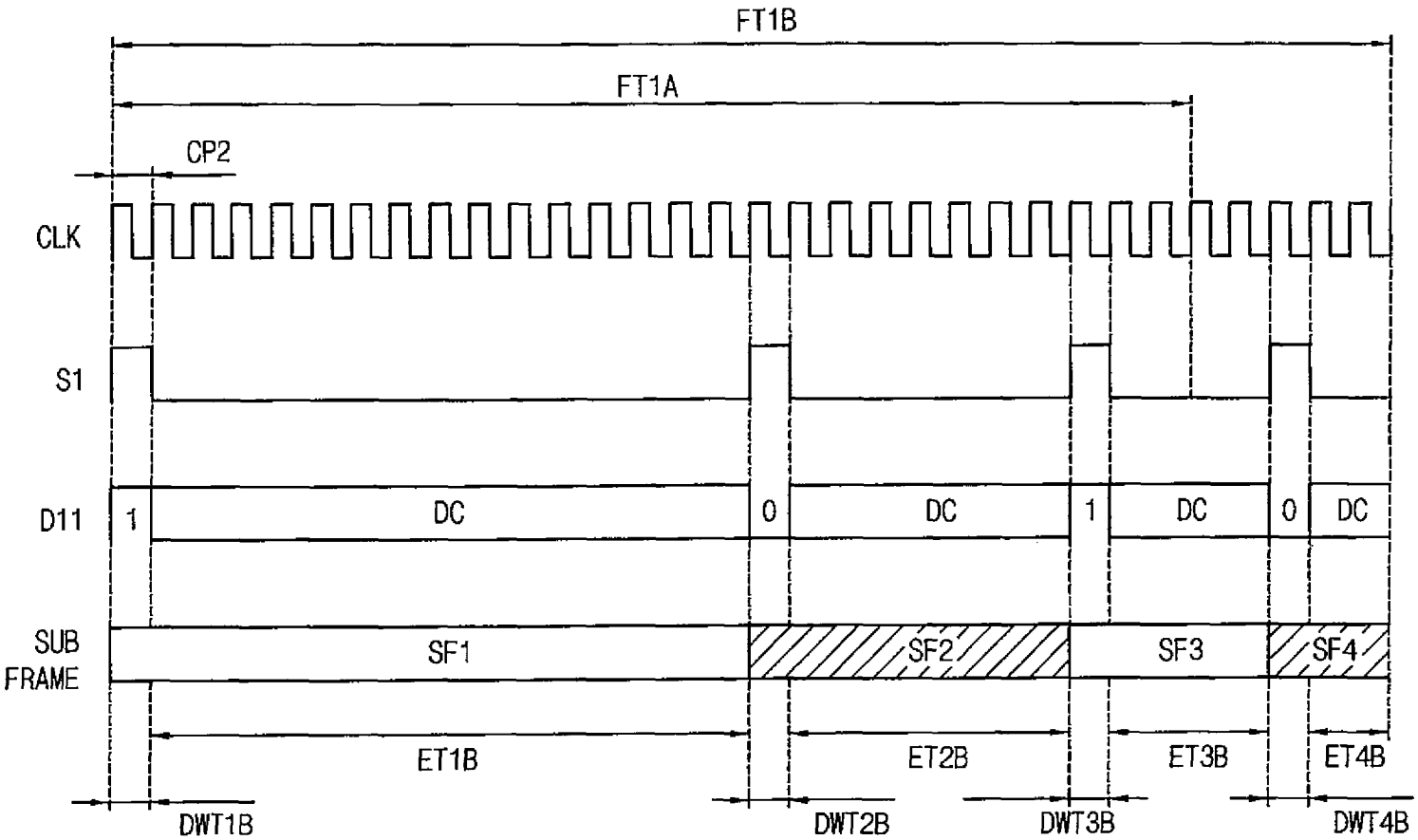

FIGS. 2 and 3 are timing diagrams illustrating operation of the first pixel included in the OLED display device of FIG. 1.

FIG. 2 is a timing diagram illustrating digital driving of the first pixel P1 according to an existing scheme without vertical blank periods. FIG. 2 shows the case in which the first frame period includes 4 sub-frame periods SF1, SF2, SF3, and SF4. The first sub-frame period SF1 includes a first data writing time DWT1A and a first light emitting time ET1A. The second sub-frame period SF2 includes a second data writing time DWT2A and a second light emitting time ET2A. The third sub-frame period SF3 includes a third data writing time DWT3A and a third light emitting time ET3A. The fourth sub-frame period SF4 includes a fourth data writing time DWT4A and a fourth light emitting time ET4A.

Time allocated to a first frame is referred to as the first frame period FT1A. Period of the clock signal CLK in the first frame period FT1A is a first period CP1. The first pixel P1 emits light during the first light emitting time ET1A for 15 clock cycles because the first scan signal S1 is activated and the first odd row data signal D11 has logical value 1 during the first data writing time DWT1A. The first pixel P1 does not emit light during the second light emitting time ET2A for 7 clock cycles because the first scan signal S1 is activated and the first odd row data signal D11 has logical value 0 during the second data writing time DWT2A. The first pixel P1 emits light during the third light emitting time ET3A for 4 clock cycles because the first scan signal S1 is activated and the first odd row data signal D11 has logical value 1 during the third data writing time DWT3A. The first pixel P1 does not emit light during the fourth light emitting time ET4A for 2 clock cycles because the first scan signal S1 is activated and the first odd row data signal D11 has logical value 0 during the fourth data writing time DWT4A.

Because the maximum gray level of the first pixel P1 is LMAX and sum of lengths of the first through fourth light emitting times ET1A, ET2A, ET3A, and ET4A included in the first frame period FT1A is 28 clock cycles and sum of the lengths of the light emitting sub-frame periods SF1, SF3 is 19 clock cycles, the gray level, which the first pixel P1 represents during the first frame period FT1A according to the timing diagram of FIG. 2, is (19/28)*LMAX.

The first data bits DB1 may represent whether or not pixels included in the (2K−1)-th row pixel blocks RPB1, RPB3 through RPB2M−1 emit light in the sub-frame periods SF1, SF2, SF3, and SF4 sequentially, and the second data bits DB2 represent whether or not pixels included in the (2K)-th row pixel blocks RPB2, RPB4, RPB2M emit light in the sub-frame periods SF1, SF2, SF3, and SF4 sequentially.

FIG. 3 is a timing diagram illustrating digital driving of the first pixel when the period of clock signal CLK is increased.

Referring to FIG. 3, the period of clock signal CLK is a second period CP2 which is longer than the first period CP1. Time required to display the first frame is increased to a second frame period FT1B. However, time allocated to a first frame is fixed to the first frame period FT1A.

Because the maximum gray level of the first pixel P1 is LMAX and sum of lengths of the first through third light emitting times ET1A, ET2A, and ET3A included in the first frame period FT1A is 24 clock cycles and sum of the lengths of the light emitting sub-frame periods SF1, SF3 is 17 clock cycles, the gray level, which the first pixel P1 represents during the first frame period FT1A according to the timing diagram of FIG. 3, is (17/24)*LMAX.

Consequently, the gray level, which the first pixel P1 represents according to the timing diagram of FIG. 2, is different from the gray level, which the first pixel P1 represents according to the timing diagram of FIG. 3. The gray level of the pixels may be changed when the period of the clock signal CLK is changed.

Figure 4A:
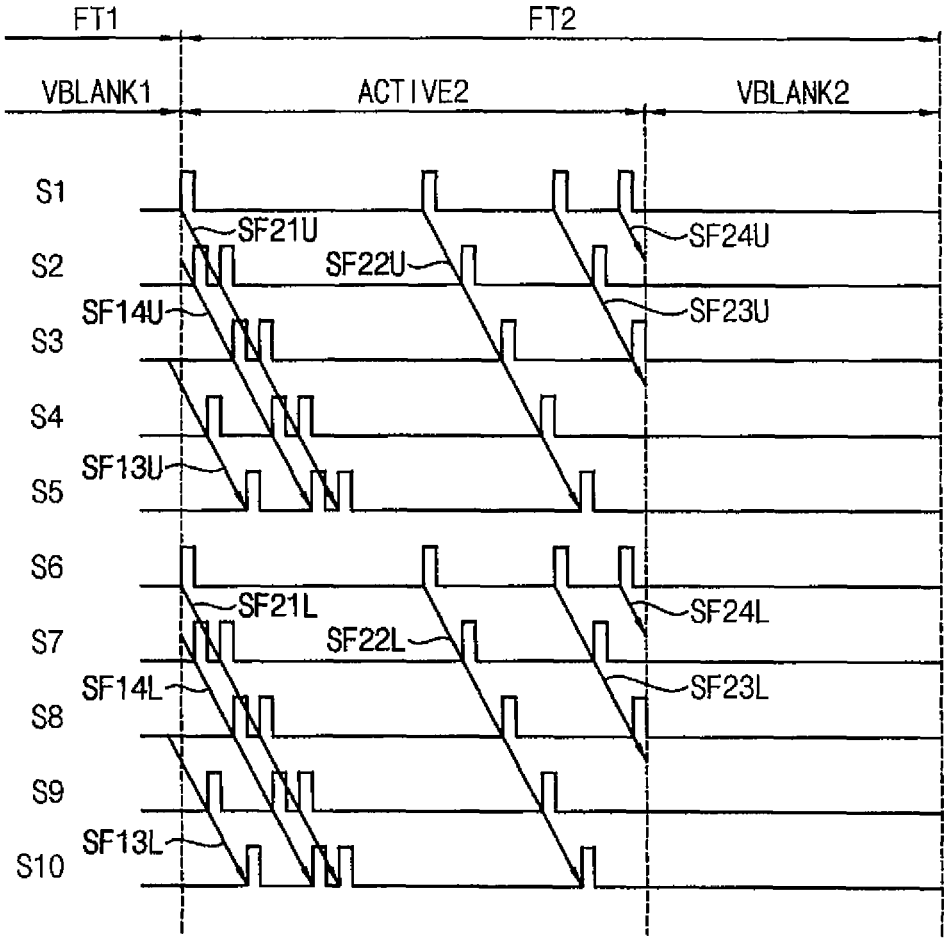
FIG. 4A is a timing diagram illustrating operation of the display panel according to a related art scheme.

FIG. 4A is a timing diagram illustrating operation of the display panel according to an existing scheme.

Referring to FIG. 4A, the first frame period FT1 includes a first activation period and a vertical blank period VBLANK1. The second frame period FT2 includes a second activation period ACTIVE 2 and a second vertical blank period VBLANK2. The first vertical blank period VBLANK1 and the second vertical blank period VBLANK2 exist to reduce gray level change caused by changing the frequency of the clock signal CLK.

Figure 4B:
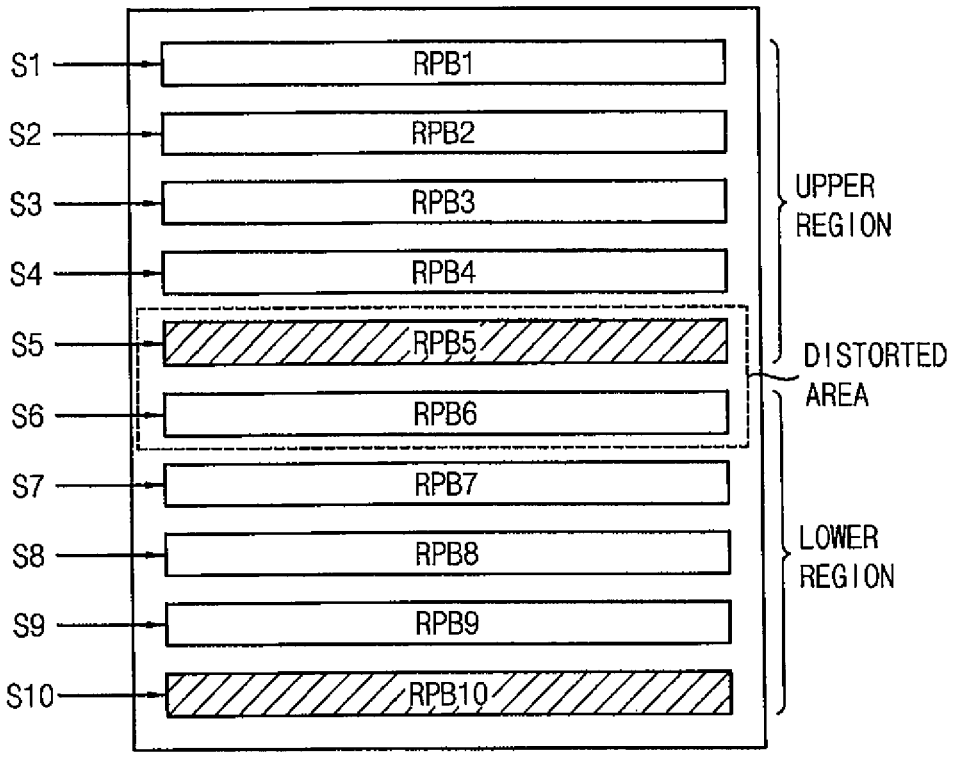
FIG. 4B is a block diagram illustrating a display panel which operates as the timing diagram of FIG. 4A.

FIGS. 4A and 4B show the case in which the number of the scan lines (2M) is 10.

The first scan signals S1, S2, S3, S4, and S5 may be activated sequentially in pulse form from the first scan signal S1 to the fifth scan signal S5 in the second activation period ACTIVE 2, and the second scan signals S6, S7, S8, S9, and S10 may be activated sequentially in pulse form from the sixth scan signal S6 to the tenth scan signal 810 in the second activation period ACTIVE 2.

For example, rising edges of scan pulses, which correspond to a third sub-frame period of the first frame period FT1 and included in the first scan signals S1, S2, S3, S4, and S5, may be on a first line SF13U. Rising edges of scan pulses, which correspond to a fourth sub-frame period of the first frame period FT1 and included in the first scan signals S1, S2, S3, S4, and S5, may be on a second line SF14U. Rising edges of scan pulses, which correspond to a first sub-frame period of the second frame period FT2 and included in the first scan signals S1, S2, S3, S4, and S5, may be on a third line SF21U. Rising edges of scan pulses, which correspond to a second sub-frame period of the second frame period FT2 and included in the first scan signals S1, S2, S3, S4, and S5, may be on a fourth line SF22U. Rising edges of scan pulses, which correspond to a third sub-frame period of the second frame period FT2 and included in the first scan signals S1, S2, S3, S4, and S5, may be on a fifth line SF23U. Rising edges of scan pulses, which correspond to a fourth sub-frame period of the second frame period FT2 and included in the first scan signals S1, S2, S3, S4, and S5, may be on a sixth line SF24U.

Rising edges of scan pulses, which correspond to a third sub-frame period of the first frame period FT1 and included in the second scan signals S6, S7, S8, S9, and S10, may be on a seventh line SF13L. Rising edges of scan pulses, which correspond to a fourth sub-frame period of the first frame period FT1 and included in the second scan signals S6, S7, S8, S9, and S10, may be on a eighth line SF14L. Rising edges of scan pulses, which correspond to a first sub-frame period of the second frame period FT2 and included in the second scan signals S6, S7, S8, S9, and S10, may be on a ninth line SF21L. Rising edges of scan pulses, which correspond to a second sub-frame period of the second frame period FT2 and included in the second scan signals S6, S7, S8, S9, and S10, may be on a tenth line SF22L. Rising edges of scan pulses, which correspond to a third sub-frame period of the second frame period FT2 and included in the second scan signals S6, S7, S8, S9, and S10, may be on a eleventh line SF23L. Rising edges of scan pulses, which correspond to a fourth sub-frame period of the second frame period FT2 and included in the second scan signals S6, S7, S8, S9, and S10, may be on a twelfth line SF24L.

The display panel may display an image in response to the input image data R, G, and B in the second activation period ACTIVE 2. The display panel may maintain a last image, which is displayed at end of the second activation period ACTIVE 2, in the second vertical blank period VBLANK2.

FIG. 4B is a block diagram illustrating a display panel which operates as according to the timing diagram of FIG. 4A.

Referring to FIGS. 4A and 4B, the existing art scheme divides the display panel to an upper region UPPER REGION and a lower region LOWER REGION. The upper region UPPER REGION includes first through fifth row pixel blocks RPB1, RPB2, RPB3, RPB4, and RPB5. The lower region LOWER REGION includes sixth through tenth row pixel blocks RPB6, RPB7, RPB8, RPB9, and RPB10.

Because the fifth scan signal S5 and the sixth scan signal S6 correspond to two neighboring scan lines respectively, the difference between a data signal corresponding to the fifth scan signal S5 and a data signal corresponding to the sixth scan signal may be little. However, the difference between allocated times for sub-frames in the fifth scan signal S5 and allocated times for sub-frames in the sixth scan signal S6 in FIG. 5 is not insignificant. Consequently, a distorted area DISTORED AREA is generated between the fifth row pixel block RPB5 and the sixth row pixel block RPB6.

Figure 5A:
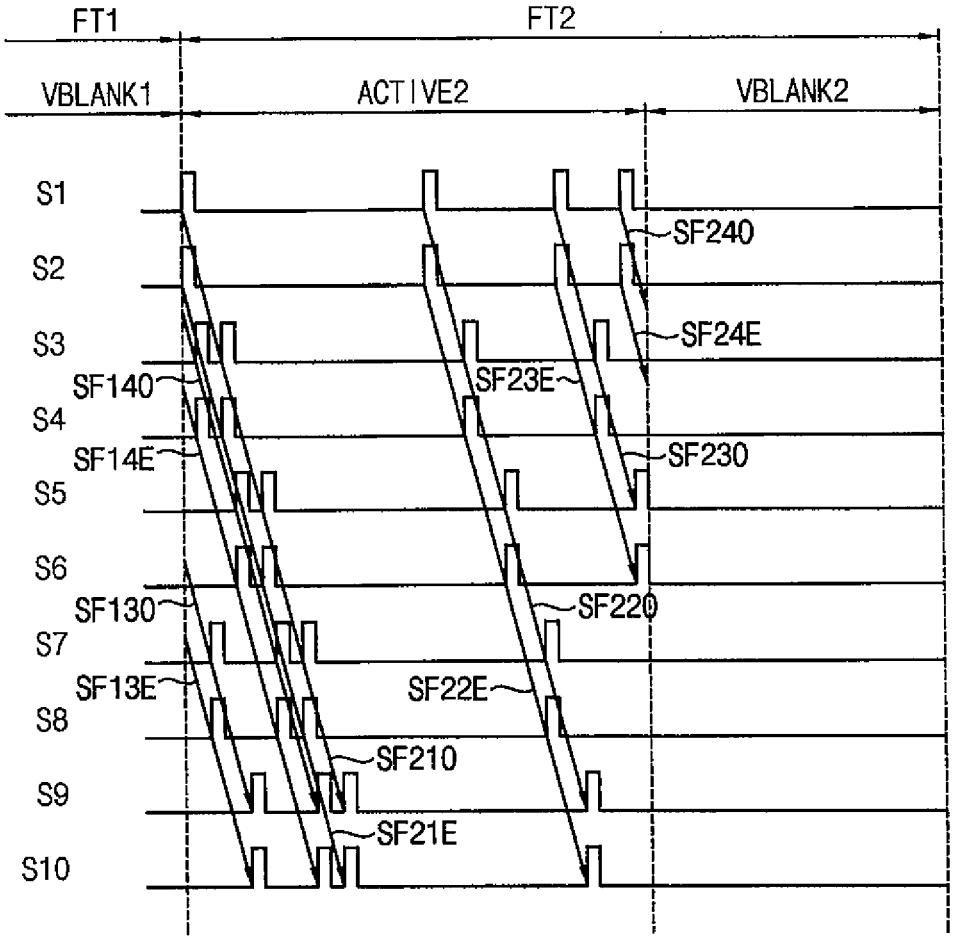
FIG. 5A is a timing diagram illustrating a first example of operation of the display panel included in the OLED display device of FIG. 1.

FIG. 5A is a timing diagram illustrating a first example of operation of the display panel included in the OLED display device of FIG. 1.

Referring to FIG. 5A, the first scan driving unit SCAN DRIVING UNIT 1 may activate the first scan signals S1, S3, S5, S7, and S9 sequentially in pulse form from the first scan signal S1 to the ninth scan signal S9, and the second scan driving unit SCAN DRIVING UNIT 2 may activate the second scan signals S2, S4, S6, S8, and S10 sequentially in pulse form from the second scan S2 signal to the tenth scan signal S10.

For example, rising edges of scan pulses, which correspond to a third sub-frame period of the first frame period FT1 and included in the first scan signals S1, S3, S5, S7, and S9, may be on a first line SF130. Rising edges of scan pulses, which correspond to a fourth sub-frame period of the first frame period FT1 and included in the first scan signals S1, S3, S5, S7, and S9, may be on a second line SF140. Rising edges of scan pulses, which correspond to a first sub-frame period of the second frame period FT2 and included in the first scan signals S1, S3, S5, S7, and S9, may be on a third line SF210. Rising edges of scan pulses, which correspond to a second sub-frame period of the second frame period FT2 and included in the first scan signals S1, S3, S5, S7, and S9, may be on a fourth line SF220. Rising edges of scan pulses, which correspond to a third sub-frame period of the second frame period FT2 and included in the first scan signals S1, S3, S5, S7, and S9, may be on a fifth line SF230. Rising edges of scan pulses, which correspond to a fourth sub-frame period of the second frame period FT2 and included in the first scan signals S1, S3, S5, S7, and S9, may be on a sixth line SF240.

Rising edges of scan pulses, which correspond to a third sub-frame period of the first frame period FT1 and included in the second scan signals S2, S4, S6, S8, and S10, may be on a seventh line SF13E. Rising edges of scan pulses, which correspond to a fourth sub-frame period of the first frame period FT1 and included in the second scan signals S2, S4, S6, S8, and S10, may be on an eighth line SF14E. Rising edges of scan pulses, which correspond to a first sub-frame period of the second frame period FT2 and included in the second scan signals S2, S4, S6, S8, and S10, may be on a ninth line SF21E. Rising edges of scan pulses, which correspond to a second sub-frame period of the second frame period FT2 and included in the second scan signals S2, S4, S6, S8, and S10, may be on a tenth line SF22E. Rising edges of scan pulses, which correspond to a third sub-frame period of the second frame period FT2 and included in the second scan signals S2, S4, S6, S8, and S10, may be on a eleventh line SF23E. Rising edges of scan pulses, which correspond to a fourth sub-frame period of the second frame period FT2 and included in the second scan signals S2, S4, S6, S8, and S10, may be on a twelfth line SF24E.

The timing controller 140 may change a length of the activation periods ACTIVE 2 and a length of the vertical blank periods VBLANK1, VBLANK2 according to a frequency of the clock signal CLK when the frequency of the clock signal CLK is changed. The timing controller 140 may calculate a luminance level of the second frame period FT2 in the first vertical blank period VBLANK1. The timing controller 140 may determine an image effect of the second frame period FT2 in the first vertical blank period VBLANK1.

Figure 5B:
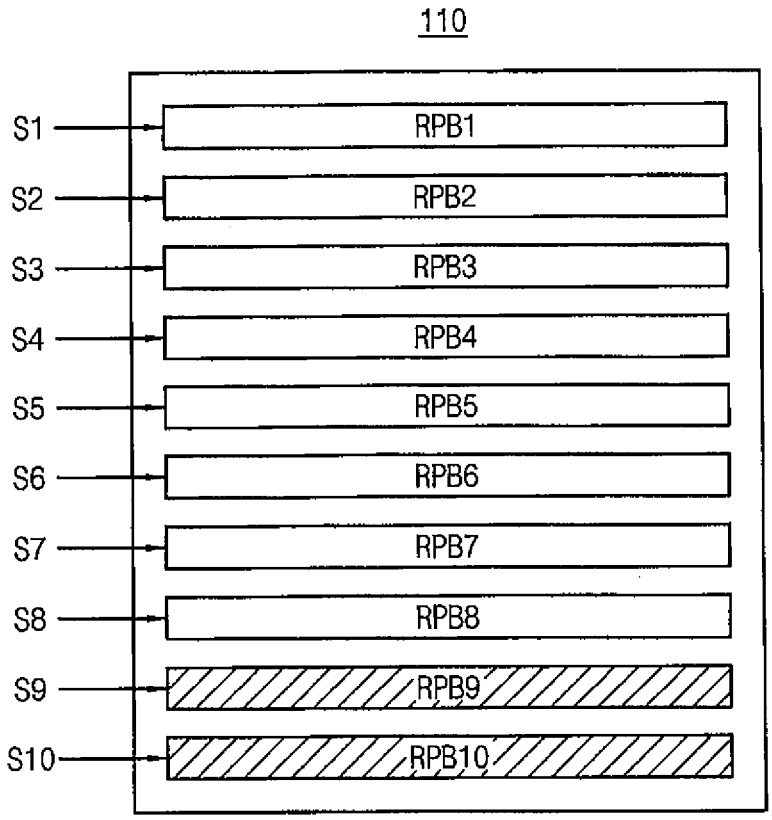
FIG. 5B is a block diagram illustrating a display panel which operates as the timing diagram of FIG. 5A and is included in the OLED display device of FIG. 1.

FIG. 5B is a block diagram illustrating a display panel which operates as the timing diagram of FIG. 5A and is included in the OLED display device of FIG. 1. The distorted area DISTORTED AREA of FIG. 4B is not generated in FIG. 5B.

Figure 6A:
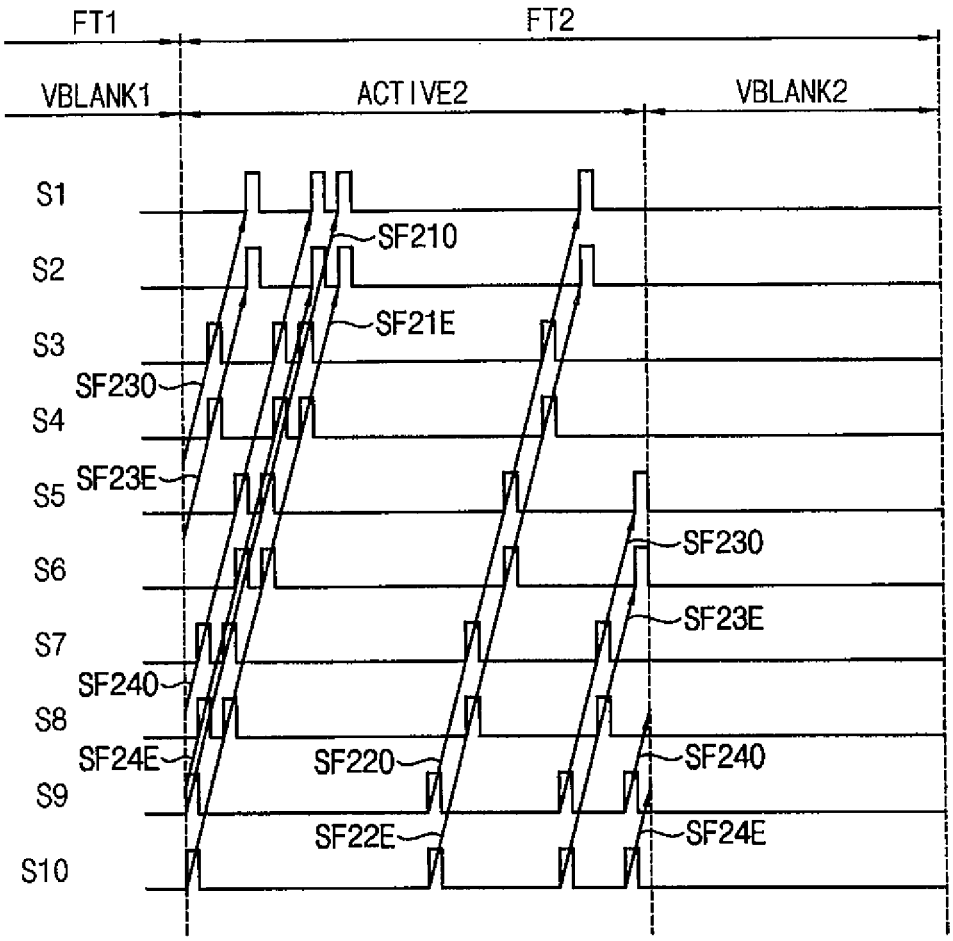
FIG. 6A is a timing diagram illustrating a second example of operation of the display panel included in the OLED display device of FIG. 1.

FIG. 6A is a timing diagram illustrating a second example of operation of the display panel included in the OLED display device of FIG. 1.

Referring to FIG. 6A, the first scan driving unit SCAN DRIVING UNIT 1 may activate the first scan signals S1, S3, S5, S7, and S9 sequentially in pulse form from the ninth scan signal S9 to the first scan signal S1, and the second scan driving unit SCAN DRIVING UNIT 2 may activate the second scan signals S2, S4, S6, S8, and S10 sequentially in pulse form from the tenth scan S10 signal to the second scan signal S2. The operation of the scan signals S1 through S10 may be understood based on the reference to FIG. 6.

Figure 6B:
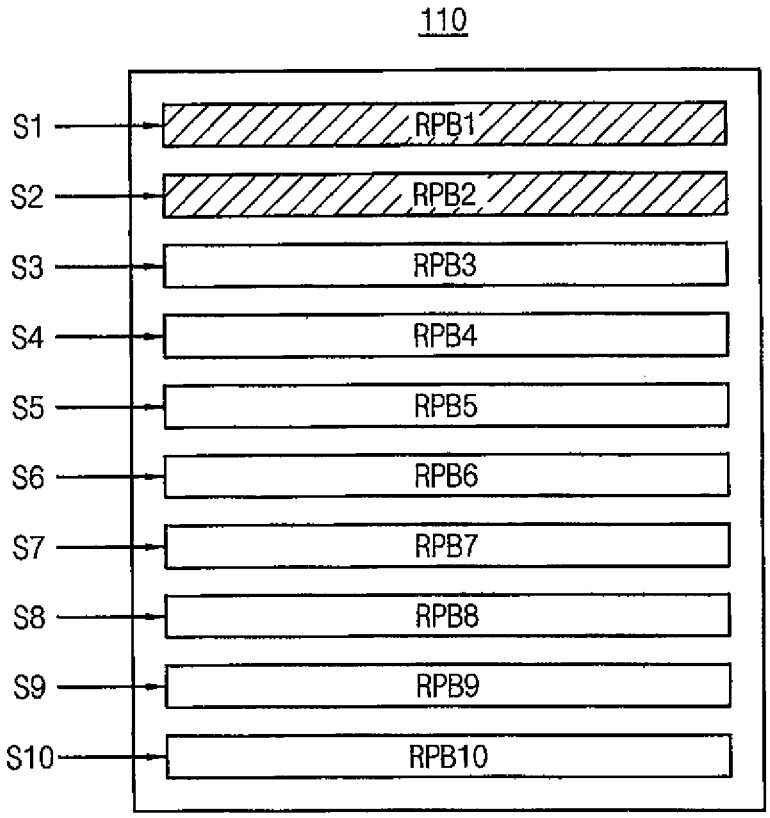
FIG. 6B is a block diagram illustrating another display panel which operates as the timing diagram of FIG. 6A and is included in the OLED display device of FIG. 1.

FIG. 6B is a block diagram illustrating another display panel which operates as the timing diagram of FIG. 6A and is included in the OLED display device of FIG. 1. The distorted area DISTORTED AREA of FIG. 4B is not generated in FIG. 6B.

Figure 7:
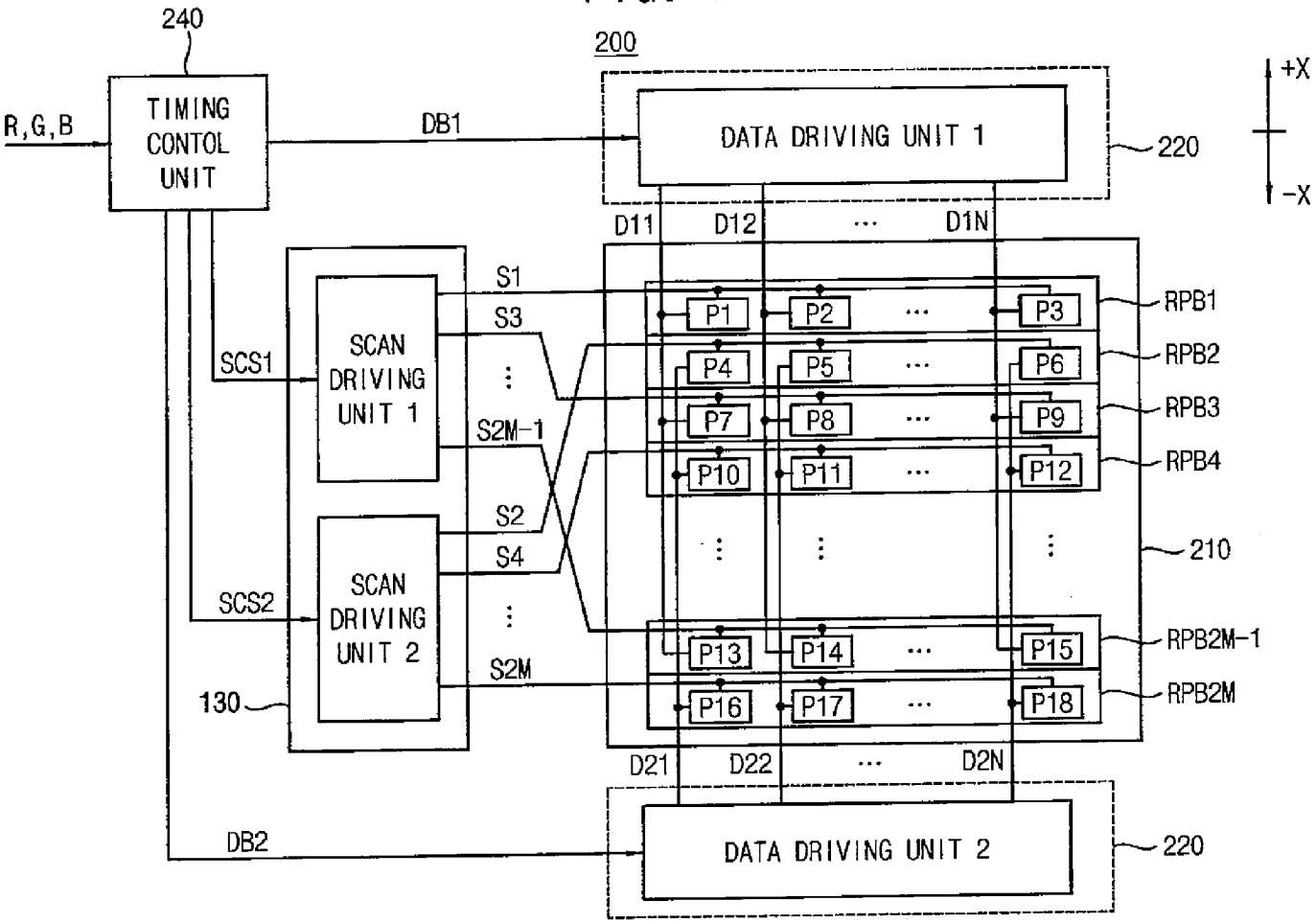
FIG. 7 is a block diagram illustrating an OLED display device according to another example embodiment.

FIG. 7 is a block diagram illustrating an OLED display device according to another example embodiment of the present invention.

Referring to FIG. 7, an OLED display device 200 may have the same, substantially the same, or similar structure with the OLED display device 100 of FIG. 1 except for the location of the first data driving unit DATA DRIVING UNIT 1 and the second data driving unit DATA DRIVING UNIT 2.

The first data driving unit DATA DRIVING UNIT 1 may be adjacent to the +X direction surface of the display panel 210, and may provide the N odd row data signals D11, D12, . . . , D1N to the display panel 210 in −X direction. The second data driving unit DATA DRIVING UNIT 2 may be adjacent to the −X direction surface of the display panel 210, and may provide the N even row data signals D21, D22, D2N to the display panel 210 in +X direction.

Figure 8:
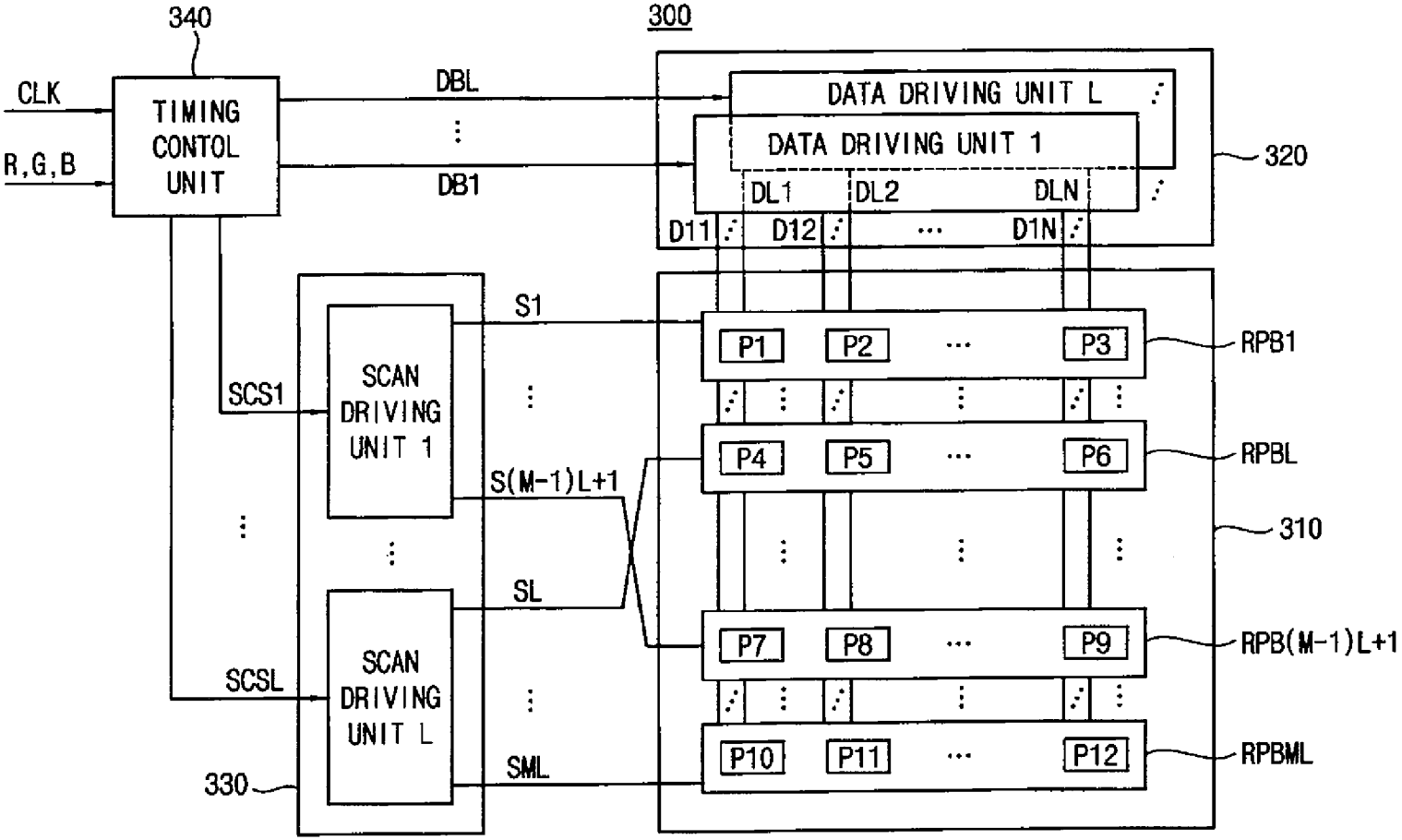
FIG. 8 is a block diagram illustrating an OLED display device according to still another example embodiment.

FIG. 8 is a block diagram illustrating an OLED display device according to still another example embodiment of the present invention.

Referring to FIG. 8, an OLED display device 300 includes a display panel 310, a timing controller 340, a data driver 320, and a scan driver 330. The display panel 310 includes first through (M*L)-th row pixel blocks RPB1, RPBL, RPB(M−1)L+1, RPBML (M, L are natural numbers respectively). Each of the first through (M*L)-th row pixel blocks RPB1, RPBL, RPB(M−1)L+1, RPBML has N pixels (N is a natural umber). The data driver 320 includes first through (L)-th data driving units DATA DRIVING UNIT 1 through DATA DRIVING UNIT L. The scan driver 330 includes first through (L)-th scan driving units SCAN DRIVING UNIT 1 through SCAN DRIVING UNIT L.

The timing controller 340 generates first through (L)-th data bits DB1 through DBL and first through (L)-th scan control signals SCS1 through SCSL based on a clock signal CLK and input image data R, G, and B. The (P)-th data driving unit (P is a natural number equal to or less than L) generates (P)-th data signals in response to the (P)-th data bits and provides the (P)-th data signals to the (K*L+P)-th row pixel blocks (K=0, 1, . . . , M−1). For example, the first data driving unit DATA DRIVING UNIT 1 generates the first data signals D11, D12, . . . , D1N in response to the first data bits DB1, and provides the first data signals D11, D12, . . . , D1N to the first row pixel block RPB1 through the ((M−1)*L+1)-th row pixel block RPB(M−1)L+1. The second data driving unit generates the second data signals in response to the second data bits, and provides the second data signals to the second row pixel block RPB2 through the ((M−1)*L+2)-th row pixel block. The (L)-th data driving unit DATA DRIVING UNIT L generates the (L)-th data signals DL1, DL2, DLN in response to the (L)-th data bits DBL, and provides the (L)-th data signals DL1, DL2, DLN to the (L)-th row pixel block RPBL through the (M*L)-th row pixel block RPBML.

The (P)-th scan driving unit generates (K*L+P)-th scan signals in response to the (P)-th scan control signal and provides the (K*L+P)-th scan signals to the (K*L+P)-th row pixel blocks, respectively. For example, the first scan driving unit SCAN DRIVING UNIT 1 generates the first scan signal S1 through the ((M−1)*L+1)-th scan signal S(M−1)L+1 in response to the first scan control signal SCS1 and provides the first scan signal S1 through the ((M−1)*L+1)-th scan signal S(M−1)L+1 to the first row pixel block RPB1 through ((M−1)*L+1)-th row pixel block RPB(M−1)L+1. The second scan driving unit generates the second scan signal through the ((M−1)*L+2)-th scan signal in response to the second scan control signal and provides the second scan signal through the ((M−1)*L+2)-th scan signal to the second row pixel block through ((M−1)*L+2)-th row pixel block, respectively. The (L)-th scan driving unit SCAN DRIVING UNIT L generates the (L)-th scan signal SL through the (M*L)-th scan signal SML in response to the (L)-th scan control signal SCSL and provides the (L)-th scan signal SL through the (M*L)-th scan signal SML to the (L)-th row pixel block RPBL through (M*L)-th row pixel block RPBML, respectively.

A frame period includes an activation period and a vertical blank period. The (P)-th scan driving unit activates the (K*L+P)-th scan signals sequentially in pulse form in the activation period. For example, the first scan driving unit SCAN DRIVING UNIT 1 activates the first scan signal S1 through the ((M−1)*L+1)-th scan signal S(M−1)L+1 sequentially in pulse form in the activation period. The second scan driving unit activates the second scan signal through the ((M−1)*L+2)-th scan signal sequentially in pulse form in the activation period. The (L)-th scan driving unit SCAN DRIVING UNIT L activates the (L)-th scan signal SL through (M*L)-th scan signal SML sequentially in pulse form in the activation period. The first through (L)-th scan driving units SCAN DRIVING UNIT 1 through SCAN DRIVING UNIT L deactivate the first through (M*L)-th scan signals S1 through SML in the vertical blank period, respectively.

In an example embodiment, the (P)-th scan driving unit may activate the (K*L+P)-th scan signals sequentially in pulse form from the (P)-th scan signal to the ((M−1)*L+P)-th scan signal in the activation period. For example, the first scan driving unit SCAN DRIVING UNIT 1 may activate the first scan signal S1 through the ((M−1)*L+1)-th scan signal S(M−1)L+1 sequentially in pulse form from the first scan signal S1 to the ((M−1)*L+1)-th scan signal S(M−1)L+1. The second scan driving unit may activate the second scan signal through the ((M−1)*L+2)-th scan signal sequentially in pulse form from the second scan signal to the ((M−1)*L+2)-th scan signal. The (L)-th scan driving unit SCAN DRIVING UNIT L may activate the (L)-th scan signal SL through the (M*L)-th scan signal SML sequentially in pulse form from the (L)-th scan signal SL to the (M*L)-th scan signal SML.

In an example embodiment, the (P)-th scan driving unit may activate the (K+L+P)-th scan signals sequentially in pulse form from the ((M−1)*L+P)-th scan signal to the (P)-th scan signal in the activation period. For example, the first scan driving unit SCAN DRIVING UNIT 1 may activate the first scan signal S1 through the ((M−1)L+1)-th scan signal S(M−1)L+1 sequentially in pulse form from the ((M−1)*L+1)-th scan signal S(M−1)L+1 to the first scan signal S1. The second scan driving unit may activate the second scan signal through the ((M−1)*L+2)-th scan signal sequentially in pulse form from the ((M−1)*L+2)-th scan signal to the second scan signal, respectively. The (L)-th scan driving unit SCAN DRIVING UNIT L may activate the (L)-th scan signal SL through the (M*L)-th scan signal SML sequentially in pulse form from the (M*L)-th scan signal SML to the (L)-th scan signal SL.

The operation of the first through the (M*L)-th scan signals S1 through SML in the frame period, the activation period, and the vertical blank period may be understood based on the references to FIGS. 2, 3, 4A, 5A, and 6A.

Figure 9:
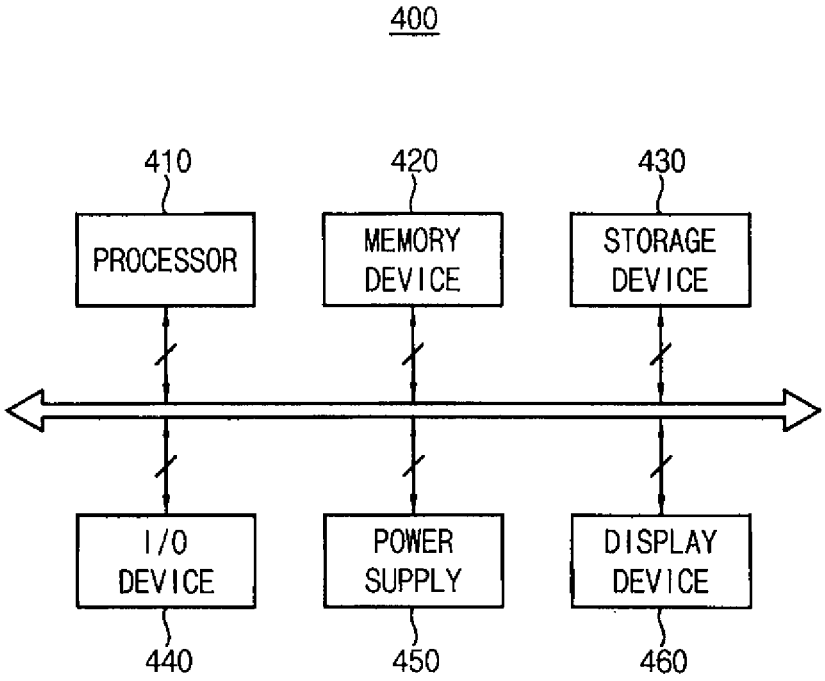
FIG. 9 is a block diagram illustrating an electronic device including an OLED display device according to example embodiments.

FIG. 9 is a block diagram illustrating an electronic device including an OLED display device according to example embodiments of the present invention.

Referring to FIG. 9, an electronic device 400 may include a processor 410, a memory device 420, a storage device 430, an input/output (I/O) device 440, a power supply 450, and an organic light emitting diode (OLED) display device 460. Here, the electronic device 400 may further include a plurality of ports for communicating with a video card, a sound card, a memory card, a universal serial bus (USB)

device, other electronic devices, etc. Although the electronic device 400 is implemented as a smart-phone, a kind of the electronic device 400 is not limited thereto.

The processor 410 may perform various computing functions. The processor 410 may be a microprocessor, a central processing unit (CPU), etc. The processor 410 may be coupled to other components via an address bus, a control bus, a data bus, etc. Further, the processor 410 may be coupled to an extended bus such as a peripheral component interconnection (PCI) bus.

The memory device 420 may store data for operations of the electronic device 400. For example, the memory device 420 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc.

The storage device 430 may be a solid state drive (SSD) device, a hard disk drive (HDD) device, a CD-ROM device, etc. The I/O device 440 may be an input device such as a keyboard, a keypad, a touchpad, a touch-screen, a mouse, etc., and an output device such as a printer, a speaker, etc. The power supply 450 may provide a power for operations of the electronic device 400. The OLED display device 460 may communicate with other components via the buses or other communication links.

The OLED display device 460 may be one of the OLED display devices 100, 200, and 300 of FIGS. 1, 7, and 8. The OLED display device 460 may be understood based on the references to FIGS. 1 through 8.

The example embodiments may be applied to any suitable electronic system 400 having the OLED display device 460. For example, embodiments of the present invention may be applied to the electronic system 400, such as a digital or 3D television, a computer monitor, a home appliance, a laptop, a digital camera, a cellular phone, a smart phone, a personal digital assistant (PDA), a portable multimedia player (PMP), a MP3 player, a portable game console, a navigation system, a video phone, etc.

The foregoing is illustrative of example embodiments and is not to be construed as limiting thereof. Although a few example embodiments have been described, those skilled in the art will readily appreciate that many modifications of the example embodiments are possible without materially departing from the novel teachings and aspects of the present invention. Accordingly, all such modifications are intended to be included within the scope of the present invention as defined by the claims and their equivalents. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. An organic light emitting diode (OLED) display device comprising:

a display panel comprising first through (2M)-th row pixel blocks, each of the first through (2M)-th row pixel blocks comprising N pixels, wherein M and N are natural numbers;

a timing controller configured to generate first data bits, second data bits, first scan control signals, and second scan control signals based on a clock signal and input image data;

a data driver comprising:

a first data driving unit configured to generate N odd row data signals in response to the first data bits and to provide the N odd row data signals to the (2K−1)-th row pixel blocks (K=1, 2, . . . , M); and a second data driving unit configured to generate N even row data signals in response to the second data bits and to provide the N even row data signals to the (2K)-th row pixel blocks; and a scan driver comprising:

a first scan driving unit configured to generate (2K−1)-th scan signals in response to the first scan control signal and to provide the (2K−1)-th scan signals to the (2K−1)-th row pixel blocks, respectively; and a second scan driving unit configured to generate (2K)-th scan signals in response to the second scan control signal and to provide the (2K)-th scan signals to the (2K)-th row pixel blocks, respectively, wherein a first frame period comprises an activation period and a vertical blank period, wherein the first scan driving unit is configured to activate the (2K−1)-th scan signals sequentially in pulse form in the activation period such that the (2K−1)-th row pixel blocks sequentially receive the N odd row data signals in the activation period of the first frame period, wherein the second scan driving unit is configured to activate the (2K)-th scan signals sequentially in pulse form in the activation period such that the (2K)-th row pixel blocks sequentially receive the N even row data signals in the activation period of the first frame period, and wherein the first and second scan driving units are configured to deactivate the first through (2M)-th scan signals in the vertical blank period.

2. The OLED display device of claim 1, wherein the first scan driving unit is configured to activate the (2K−1)-th scan signals sequentially in pulse form from the first scan signal to the (2M−1)-th scan signal in the activation period, and wherein the second scan driving unit is configured to activate the (2K)-th scan signals sequentially in pulse form from the second scan signal to the (2M)-th scan signal in the activation period.

3. The OLED display device of claim 1, wherein the first scan driving unit is configured to activate the (2K−1)-th scan signals sequentially in pulse form from the (2M−1)-th scan signal to the first scan signal in the activation period, and wherein the second scan driving unit is configured to activate the (2K)-th scan signals sequentially in pulse form from the (2M)-th scan signal to the second scan signal in the activation period.

4. The OLED display device of claim 1, wherein the first scan driving unit is configured to activate the (2K−1)-th scan signals selectively in the activation period, and wherein the second scan driving unit is configured to activate the (2K)-th scan signals selectively in the activation period.

5. The OLED display device of claim 1, wherein the (2K−1)-th scan signals are the same as the (2K)-th scan signals.

6. The OLED display device of claim 1, wherein the (L)-th row pixel block is adjacent to the (L+1)-th row pixel block, and wherein L is a natural number equal to or less than 2M.

7. The OLED display device of claim 1, wherein the N pixels in the (L)-th row pixel block are configured to operate in response to the (L)-th scan signal, and wherein L is a natural number equal to or less than 2M.

8. The OLED display device of claim 1, wherein the N pixels in the (2P−1)-th row pixel block are configured to operate in response to the N odd row data signals, and wherein P is a natural number equal to or less than M.

9. The OLED display device of claim 1, wherein the N pixels in the (2P)-th row pixel block are configured to operate in response to the N even row data signals, and wherein P is a natural number equal to or less than M.

10. The OLED display device of claim 1, wherein the display panel is configured to display an image in response to the input image data in the activation period.

11. The OLED display device of claim 1, wherein the display panel is configured to maintain a last image, which is displayed at end of the activation period, in the vertical blank period.

12. The OLED display device of claim 1, wherein the timing controller is configured to change a length of the activation period and a length of the vertical blank period according to a frequency of the clock signal when the frequency of the clock signal is changed.

13. The OLED display device of claim 1, wherein the timing controller is configured to calculate a luminance level of a second frame period subsequent to the first frame period in the vertical blank period.

14. The OLED display device of claim 1, wherein the timing controller is configured to determine an image effect of a second frame period subsequent to the first frame period in the vertical blank period.

15. An organic light emitting diode (OLED) display device comprising:

a display panel comprising first through (2M)-th row pixel blocks, each of the first through (2M)-th row pixel blocks comprising N pixels, wherein M and N are natural numbers;

a timing controller configured to generate first data bits, second data bits, first scan control signals, and second scan control signals based on a clock signal and input image data;

a data driver comprising:

a first data driving unit configured to generate N odd row data signals in response to the first data bits and to provide the N odd row data signals to the (2K−1)-th row pixel blocks (K=1, 2, . . . , M); and a second data driving unit configured to generate N even row data signals in response to the second data bits and to provide the N even row data signals to the (2K)-th row pixel blocks; and a scan driver comprising:

a first scan driving unit configured to generate (2K−1)-th scan signals in response to the first scan control signal and to provide the (2K−1)-th scan signals to the (2K−1)-th row pixel blocks, respectively; and a second scan driving unit configured to generate (2K)-th scan signals in response to the second scan control signal and to provide the (2K)-th scan signals to the (2K)-th row pixel blocks, respectively, wherein a first frame period comprises an activation period and a vertical blank period, wherein the first scan driving unit is configured to activate the (2K−1)-th scan signals sequentially in pulse form in the activation period, wherein the second scan driving unit is configured to activate the (2K)-th scan signals sequentially in pulse form in the activation period, wherein the first and second scan driving units are configured to deactivate the first through (2M)-th scan signals in the vertical blank period, wherein the activation period comprises a plurality of sub-frame periods, and wherein the OLED display device is configured to utilize a digital driving method which represents a gray level of a pixel in the display panel based on a sum of light emitting time of the sub-frame periods.

16. The OLED display device of claim 15, wherein the first data bits represents whether or not pixels in the (2K−1)-th row pixel blocks emit light in the sub-frame periods sequentially, and wherein the second data bits represents whether or not pixels in the (2K)-th row pixel blocks emit light in the sub-frame periods sequentially.

17. An organic light emitting diode (OLED) display device comprising:

a display panel comprising first through (M*L)-th row pixel blocks, each of the first through (M*L)-th row pixel blocks comprising N pixels, wherein L, M, and N are natural numbers;

a timing controller configured to generate first through (L)-th data bits and first through (L)-th scan control signals based on a clock signal and input image data;

a data driver comprising first through (L)-th data driving units; and a scan driver comprising first through (L)-th scan driving units, wherein the (P)-th data driving unit is configured to generate (P)-th data signals in response to the (P)-th data bits and to provide the (P)-th data signals to the (K*L+P)-th row pixel blocks (K=0, 1, . . . , M−1), wherein P is a natural number equal to or less than L, wherein the (P)-th scan driving unit is configured to generate (K*L+P)-th scan signals in response to the (P)-th scan control signal and to provide the (K*L+P)-th scan signals to the (K*L+P)-th row pixel blocks, respectively, wherein a frame period comprises an activation period and a vertical blank period, wherein the (P)-th scan driving unit is configured to activate the (K*L+P)-th scan signals sequentially in pulse form in the activation period such that the (K*L+P)-th row pixel blocks sequentially receive the (P)-th data signals in the activation period of the frame period, and wherein the first through (L)-th scan driving units are configured to deactivate the first through (M*L)-th scan signals in the vertical blank period.

18. The OLED display device of claim 17, wherein the (P)-th scan driving unit is configured to activate the (K*L+P)-th scan signals sequentially in pulse form from the (P)-th scan signal to the ((M−1)*L+P)-th scan signal in the activation period.

19. The OLED display device of claim 17, wherein the (P)-th scan driving unit is configured to activate the (K+L+

P)-th scan signals sequentially in pulse form from the ((M−1)*L+P)-th scan signal to the (P)-th scan signal in the activation period.

* * * * *